US006832418B2

(12) United States Patent
Hartgrove et al.

(10) Patent No.: US 6,832,418 B2
(45) Date of Patent: Dec. 21, 2004

(54) NONWOVEN SECONDARY CARPET BACKING

(75) Inventors: Herbert Hartgrove, Angier, NC (US); Cynthia Dawson McNaull, Wilmington, NC (US); Russell Tindall, Clemmons, NC (US)

(73) Assignee: Polymer Group, Inc., North Charleston, SC (US)

( * ) Notice: Subject to any disclaimer, the term of this patent is extended or adjusted under 35 U.S.C. 154(b) by 0 days.

(21) Appl. No.: 10/691,040

(22) Filed: Oct. 22, 2003

(65) Prior Publication Data

US 2004/0134048 A1 Jul. 15, 2004

Related U.S. Application Data

(60) Provisional application No. 60/420,149, filed on Oct. 22, 2002.

(51) Int. Cl.[7] ..... D04H 5/02
(52) U.S. Cl. ..... 28/104; 28/167
(58) Field of Search ..... 28/104, 105, 106, 28/167, 163, 140, 158; 428/95; 442/382, 384, 387, 401, 408

(56) References Cited

U.S. PATENT DOCUMENTS

| | | | | | |
|---|---|---|---|---|---|
| 3,485,705 | A | | 12/1969 | Harmon | |
| 3,485,706 | A | * | 12/1969 | Evans | 428/134 |
| 3,817,817 | A | | 6/1974 | Pickens, Jr. et al. | |
| 3,834,978 | A | | 9/1974 | Nisenson et al. | |
| 4,053,668 | A | | 10/1977 | Kummel et al. | |
| 4,190,695 | A | | 2/1980 | Niederhauser | |
| 4,258,094 | A | | 3/1981 | Benedyk | |
| 4,636,419 | A | | 1/1987 | Madsen et al. | |
| 4,808,467 | A | * | 2/1989 | Suskind et al. | 442/384 |
| 4,939,016 | A | * | 7/1990 | Radwanski et al. | 428/152 |
| 5,098,764 | A | | 3/1992 | Drelich et al. | |
| 5,144,729 | A | | 9/1992 | Austin et al. | |
| 5,187,005 | A | | 2/1993 | Stahle et al. | |
| 5,369,858 | A | * | 12/1994 | Gilmore et al. | 28/104 |
| 5,413,849 | A | * | 5/1995 | Austin et al. | 442/329 |
| 5,459,912 | A | * | 10/1995 | Oathout | 28/105 |
| 5,475,903 | A | | 12/1995 | Collins | |
| 6,022,447 | A | * | 2/2000 | Radwanski et al. | 162/115 |
| 6,060,145 | A | | 5/2000 | Smith et al. | |
| 6,163,943 | A | * | 12/2000 | Johansson et al. | 28/104 |
| 6,314,627 | B1 | * | 11/2001 | Ngai | 28/104 |
| 6,344,254 | B1 | | 2/2002 | Smith et al. | |
| 6,629,340 | B1 | * | 10/2003 | Dale et al. | 28/104 |

* cited by examiner

*Primary Examiner*—Amy B. Vanatta
(74) *Attorney, Agent, or Firm*—Wood, Phillips, Katz, Clark & Mortimer

(57) ABSTRACT

The present invention is directed to a method of forming a nonwoven fabric, which exhibits a pronounced durable three-dimensional image, permitting use of the fabric in secondary carpet backing of carpet backing systems so as to reduce deformation under normal use (walking) and provide better coverage in carpet system applications. In particular, the present invention contemplates that a fabric is formed from a precursor web comprising a spunbond and/or cast scrim, which when subjected to hydroentanglement on an imaging surface, an enhanced product is achieved. By formation in this fashion, hydroentanglement of the precursor web results in a more pronounced three-dimensional image; an image that is durable to abrasion and distortion.

2 Claims, 1 Drawing Sheet

NONWOVEN SECONDARY CARPET BACKING

This application claims benefit of U.S. Provisional Application 60/420,149 filed Oct. 22, 2002.

TECHNICAL FIELD

The present invention relates generally to methods of making nonwoven fabrics, and more particularly, to a method of manufacturing a nonwoven fabric exhibiting a durable three-dimensional image, permitting use of the fabric in secondary carpet backing systems so as to reduce deformation under normal use (walking) and improve the amount of coverage provided to the secondary carpet backing system applications.

BACKGROUND OF THE INVENTION

The production of conventional textile fabrics is known to be a complex, multi-step process. The production of fabrics from staple fibers begins with the carding process whereby the fibers are opened and aligned into a feedstock referred to in the art as "sliver". Several strands of sliver are then drawn multiple times on a drawing frames to; further align the fibers, blend, improve uniformity and reduce the sliver's diameter. The drawn sliver is then fed into a roving frame to produce roving by further reducing its diameter as well as imparting a slight false twist. The roving is then fed into the spinning frame where it is spun into yarn. The yarns are next placed onto a winder where they are transferred into larger packages. The yarn is then ready to be used to create a fabric.

For a woven fabric, the yarns are designated for specific use as warp or fill yarns. The fill yarns (which run on the y-axis and are known as picks) are taken straight to the loom for weaving. The warp yarns (which run on the x-axis and are known as ends) must be further processed. The large packages of yarns are placed onto a warper frame and are wound onto a section beam were they are aligned parallel to each other. The section beam is then fed into a slasher where a size is applied to the yarns to make them stiffer and more abrasion resistant, which is required to withstand the weaving process. The yarns are wound onto a loom beam as they exit the slasher, which is then mounted onto the back of the loom. The warp yarns are threaded through the needles of the loom, which raises and lowers the individual yarns as the filling yarns are interested perpendicular in an interlacing pattern thus weaving the yarns into a fabric. Once the fabric has been woven, it is necessary for it to go through a scouring process to remove the size from the warp yarns before it can be dyed or finished. Currently, commercial high-speed looms operate at a speed of 1000 to 1500 picks per minute, where a pick is the insertion of the filling yarn across the entire width of the fabric. Sheeting and bedding fabrics are typically counts of 80×80 to 200×200, being the ends per inch and picks per inch, respectively. The speed of weaving is determined by how quickly the filling yarns are interlaced into the warp yarns, therefore looms creating bedding fabrics are generally capable of production speeds of 5 inches to 18.75 inches per minute.

In contrast, the production of nonwoven fabrics from staple fibers is known to be more efficient than traditional textile processes, as the fabrics are produced directly from the carding process.

Nonwoven fabrics are suitable for use in a wide variety of applications where the efficiency with which the fabrics can be manufactured provides a significant economic advantage for these fabrics versus traditional textiles. However, nonwoven fabrics have commonly been disadvantaged when fabric properties are compared to conventional textiles, particularly in terms of resistance to elongation, in applications where both transverse and co-linear stresses are encountered. Hydroentangled fabrics have been developed with improved properties, by the formation of complex composite structures in order to provide a necessary level of fabric integrity. Subsequent to entanglement, fabric durability has been further enhanced by the application of binder compositions and/or by thermal stabilization of the entangled fibrous matrix.

Nonwoven composite structures typically improve physical properties, such as elongation, by way of incorporation of a support layer or scrim. The support layer material can comprise an array of polymers, such as polyolefins, polyesters, polyurethanes, polyamides, and combinations thereof, and take the form of a film, fibrous sheeting, or grid-like meshes. Metal screens, fiberglass, and vegetable fibers are also utilized as support layers. The support layer is commonly incorporated either by mechanical or chemical means to provide reinforcement to the composite fabric. Reinforcement layers, also referred to as a "scrim" material, are described in detail in U.S. Pat. No. 4,636,419, which is hereby incorporated by reference. The use of scrim material, more particularly, a spunbond scrim material is known to those skilled in the art.

Spunbond material comprises continuous filaments typically formed by extrusion of thermoplastic resins through a spinneret assembly, creating a plurality of continuous thermoplastic filaments. The filaments are then quenched and drawn, and collected to form a nonwoven web. Spunbond materials have relatively high resistance to elongation and perform well as a reinforcing layer or scrim. U.S. Pat. No. 3,485,706 to Evans, et al., which is hereby incorporated by reference, discloses a continuous filament web with an initial random staple fiber batt mechanically attached via hydroentanglement, then a second random staple fiber batt is attached to the continuous filament web, again, by hydroentanglement. A continuous filament web is also utilized in U.S. Pat. Nos. 5,144,729; 5,187,005; and 4,190,695. These patents include a continuous filament web for reinforcement purposes or to reduce elongation properties of the composite.

More recently, hydroentanglement techniques have been developed which impart images or patterns to the entangled fabric by effecting hydroentanglement on three-dimensional image transfer devices. Such three-dimensional image transfer devices are disclosed in U.S. Pat. No. 5,098,764, which is hereby incorporated by reference; with the use of such image transfer devices being desirable for providing a fabric with enhanced physical properties as well as functional dimension.

A three-dimensionally imaged nonwoven fabric exhibits a combination of specific physical characteristics so as to be beneficial in carpet backing applications. Further, three-dimensionally imaged nonwoven fabrics used in industrial applications require sufficient resistance to elongation so as to resist deformation of the image when the fabric is converted into a final end-use article and when used in the final application.

Heretofore, nonwoven fabrics have been advantageously employed for manufacture of secondary carpet backing. Generally, nonwoven fabrics employed for this type of application have been entangled and integrated by mechanical needle-punching, sometimes referred to as "needle-felting", which entails repeated insertion and withdrawal of barbed needles through a fibrous web structure. While this type of processing acts to integrate the fibrous structure and lend integrity thereto, the barbed needles inevitably shear large numbers of the constituent fibers, and undesirably create perforations in the fibrous structure, which act to compromise the integrity of the carpet backing and can inhibit proper coverage. Needle-punching can also be detrimental to the strength of the resultant fabric, requiring that a suitable nonwoven fabric have a higher basis weight in order to exhibit sufficient strength for secondary carpet backing applications.

Notwithstanding various attempts in the prior art to develop a secondary carpet backing for carpet systems, a need continues to exist for a nonwoven fabric, which provides a pronounced image for.

SUMMARY OF THE INVENTION

The present invention is directed to a method of forming a nonwoven fabric, which exhibits a pronounced durable three-dimensional image, permitting use of the fabric in secondary carpet backing of carpet backing systems so as to reduce deformation under normal use (walking) and provide better coverage in carpet system applications. In particular, the present invention contemplates that a fabric is formed from a precursor web comprising a spunbond and/or cast scrim, which when subjected to hydroentanglement on an imaging surface, an enhanced product is achieved. By formation in this fashion, hydroentanglement of the precursor web results in a more pronounced three-dimensional image; an image that is durable to abrasion and distortion.

In accordance with the present invention, a method of making a nonwoven fabric embodying the present invention includes the steps of providing a precursor web comprising a fibrous matrix. While use of staple length fibers is typical, the fibrous matrix may comprise substantially continuous filaments. In a particularly preferred form, the fibrous matrix comprises staple length fibers, which are carded and cross-lapped to form a precursor web. In one embodiment of the present invention, the precursor web is subjected to pre-entangling on a foraminous-forming surface prior to juxtaposition of a continuous filament and/or cast scrim and subsequent three-dimensional imaging. Alternately, one or more layers of fibrous matrix are juxtaposed with one or more continuous filament and/or cast scrims, then the layered construct is pre-entangled to form a precursor web which is imaged directly, or subjected to further fiber, filament, support layers, or scrim layers prior to imaging.

The present method further contemplates the provision of a three-dimensional image transfer device having a movable imaging surface. In a typical configuration, the image transfer device may comprise a drum-like apparatus, which is rotatable with respect to one or more hydroentangling manifolds.

The precursor web is advanced onto the imaging surface of the image transfer device. Hydroentanglement of the precursor web is effected to form a three-dimensionally imaged fabric. Significantly, the incorporation of at least one continuous filament or cast scrim acts to focus the fabric tension therein, allowing for improved imaging of the staple fiber layer or layers, and resulting in a more pronounced three-dimensional image.

Subsequent to hydroentanglement, the three-dimensionally imaged fabric may be subjected to one or more variety of post-entanglement treatments. Such treatments may include application of a polymeric binder composition, mechanical compacting, application of additives or electrostatic compositions, and like processes.

A further aspect of the present invention is directed to a method of forming a durable nonwoven fabric, which exhibits a pronounced and resilient three-dimensionality, while providing the necessary resistance to distortion, to facilitate use in a wide variety of industrial applications. The fabric exhibits a high degree of fiber retention, thus permitting its use in those applications in which the fabric is used as a secondary carpet backing in carpet backing systems. Further, the scrim aids in preventing the distortion of the imprinted image upon the application of tension to the composite fabric during routine processing and use.

A method of making the present durable nonwoven fabric comprises the steps of providing a precursor web, which is subjected to hydroentangling. The precursor web is formed into a three-dimensionally imaged nonwoven fabric by hydroentanglement on a three-dimensional image transfer device. The image transfer device defines three-dimensional elements against which the precursor web is forced during hydroentanglement, whereby the fibrous constituents of the web are imaged by movement into regions between the three-dimensional elements and surface asperities of the image transfer device.

In the preferred form, the precursor web is hydroentangled on a foraminous surface prior to hydroentangling on the imaging surface. This pre-entangling of the precursor web acts to integrate the fibrous components of the web, but does not impart a three-dimensional image as can be achieved through the use of the three-dimensional image transfer device.

Optionally, subsequent to three-dimensional imaging, the imaged nonwoven fabric can be treated with a performance or aesthetic modifying composition to further alter the fabric structure or to meet end-use article requirements. A polymeric binder composition can be selected to enhance durability characteristics of the fabric or an antimicrobial additive may be used utilized to deter the growth of fungus and mold.

Other features and advantages of the present invention will become readily apparent from the following detailed description, the accompanying drawings, and the appended claims.

DETAILED DESCRIPTION

Figure 1:
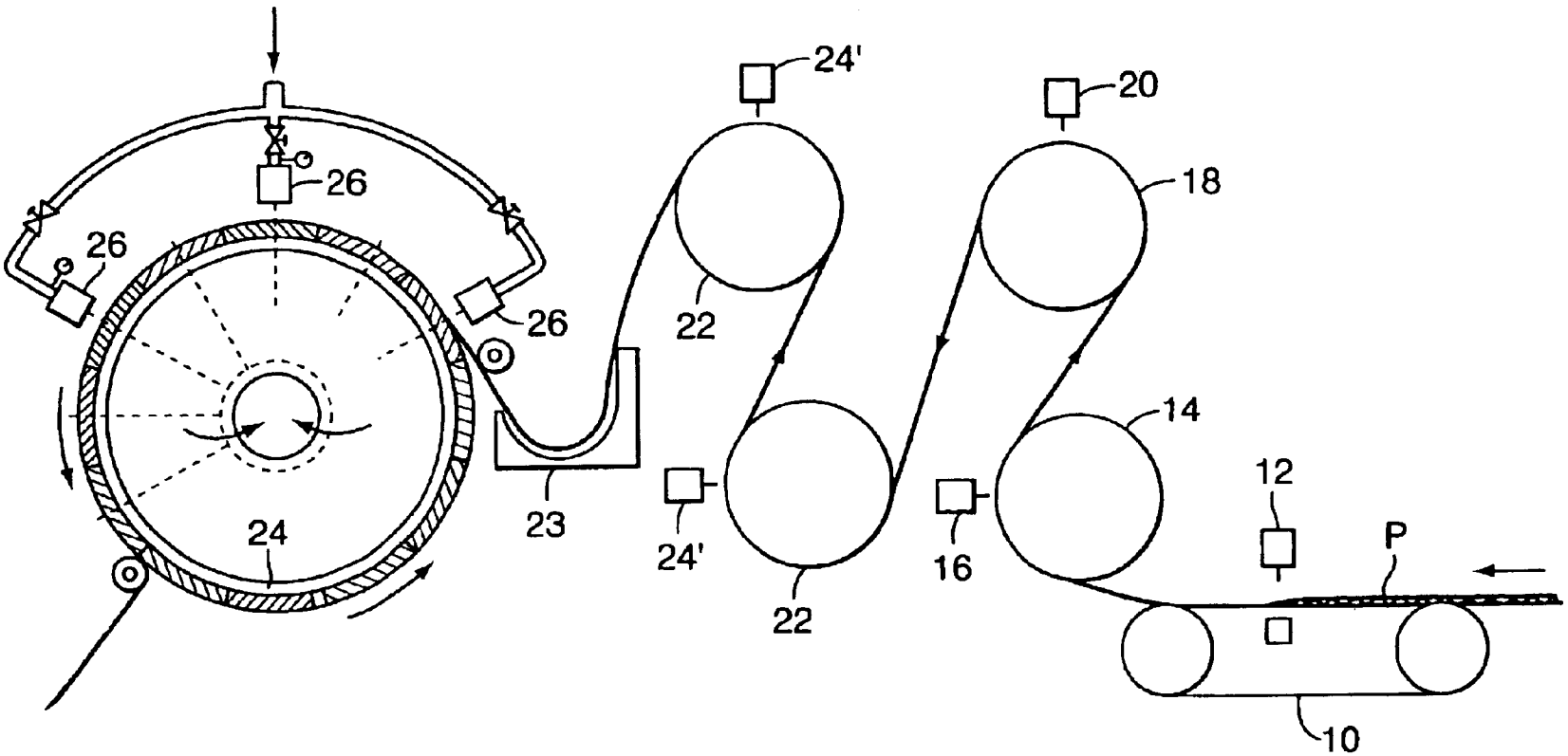
FIG. 1 is a diagrammatic view of an apparatus for manufacturing a durable nonwoven fabric, embodying the principles of the present invention.

While the present invention is susceptible of embodiment in various forms, there is shown in the drawings, and will hereinafter be described, a presently preferred embodiment of the invention, with the understanding that the present disclosure is to be considered as an exemplification of the invention, and is not intended to limit the invention to the specific embodiment illustrated.

The present invention is directed to a method of forming a durable three-dimensionally imaged nonwoven suitable for use as secondary carpet backing for carpet backing systems wherein the three-dimensional imaging of the fabrics is enhanced by the incorporation of at least one continuous filament support layer and/or cast scrim. Enhanced imaging can be achieved utilizing various techniques, one such technique involves minimizing and eliminating tension in the overall precursor web as the web is advanced onto a moveable imaging surface of the image transfer device, as represented by co-pending U.S. patent application, Ser. No. 60/344,259 to Putnam et al, entitled *Nonwoven Fabrics Having a Durable Three-Dimensional Image*, and filed on Dec. 28, 2002, which is hereby incorporated by reference. By use of a continuous filament support layer or scrim, cast scrim, or the combination thereof, enhanced fiber entanglement is achieved, with the physical properties, both aesthetic and mechanical, of the resultant fabric being desirably enhanced. It is reasonably believed that the internal support of the precursor web provided by the support layer or scrim, as the precursor web is advanced onto the image transfer device, desirably acts to focus tension to the support layer or scrim. Without tension, the fibers or filaments of the fibrous matrix, from which the precursor web is formed, can more easily move and shift during hydroentanglement, thus resulting in improved three-dimensional imaging on the image transfer device. A more clearly defined and durable image is achieved.

With reference to FIG. 1, therein is illustrated an apparatus for practicing the present method for forming a nonwoven fabric. The fabric is formed from a fibrous matrix, which typically comprises staple length fibers, but may comprise substantially continuous filaments. The fibrous matrix is preferably carded and cross-lapped to form a fibrous batt, designated F. In a current embodiment, the fibrous batt comprises 100% cross-lap fibers, that is, all of the fibers of the web have been formed by cross-lapping a carded web so that the fibers are oriented at an angle relative to the machine direction of the resultant web. U.S. Pat. No. 5,475,903, hereby incorporated by reference, illustrates a web drafting apparatus.

A continuous filament support layer or scrim, cast scrim, or a combination thereof, is then placed in face to face to face juxtaposition with the fibrous web and hydroentangled to form precursor web P. Alternately, the fibrous web can be hydroentangled first to form precursor web P, and subsequently, at least one support layer or scrim is applied to the precursor web, and the composite construct optionally further entangled with non-imaging hydraulic manifolds, then imparted a three-dimensional image on an imaging surface.

FIG. 1 illustrates a hydroentangling apparatus for forming nonwoven fabrics in accordance with the present invention. The apparatus includes a foraminous-forming surface in the form of belt 10 upon which the precursor web P is positioned for pre-entangling by entangling manifold 12. Pre-entangling of the precursor web, prior to three-dimensional imaging, is subsequently effected by movement of the web P sequentially over a drum 14 having a foraminous-forming surface, with entangling manifold 16 effecting entanglement of the web. Further entanglement of the web is effected on the foraminous forming surface of a drum 18 by entanglement manifold 20, with the web subsequently passed over successive foraminous drums 20, for successive entangling treatment by entangling manifolds 24, 24'.

The entangling apparatus of FIG. 1 further includes a three-dimensional imaging drum 24 comprising a three-dimensional image transfer device for effecting imaging of the now-entangled precursor web. The image transfer device includes a moveable imaging surface which moves relative to a plurality of entangling manifolds 26 which act in cooperation with three-dimensional elements defined by the imaging surface of the image transfer device to effect imaging and patterning of the fabric being formed.

The present invention contemplates that the support layer or scrim be any such suitable continuous filament nonwoven material, cast scrim, or combination thereof, including, but not limited to a spunbond fabric, a spunbond-meltblown laminate, or a spunbond-spunbond laminate, which exhibit low elongation performance. A particularly preferred embodiment of support layer or scrim is a thermoplastic spunbond nonwoven fabric. The support layer may be maintained in a wound roll form, which is then continuously fed into the formation of the precursor web, and/or supplied by a direct spinning beam located in advance of the three-dimensional imaging drum 24.

Manufacture of a durable nonwoven fabric embodying the principles of the present invention is initiated by providing the fibrous matrix, which can include the use of staple length fibers, continuous filaments, and the blends of fibers and/or filaments having the same or different composition. Fibers and/or filaments are selected from natural or synthetic composition, of homogeneous or mixed fiber length. Suitable natural fibers include, but are not limited to, cotton, wood pulp and viscose rayon. Synthetic fibers, which may be blended in whole or part, include thermoplastic and thermoset polymers. Thermoplastic polymers suitable for blending with dispersant thermoplastic resins include polyolefins, polyamides and polyesters. The thermoplastic polymers may be further selected from homopolymers; copolymers, conjugates and other derivatives including those thermoplastic polymers having incorporated melt additives or surface-active agents. Staple lengths are selected in the range of 0.25 inch to 10 inches, the range of 1 to 3 inches being preferred and the fiber denier selected in the range of 1 to 22, the range of 1.2 to 6 denier being preferred for general applications. The profile of the fiber and/or filament is not a limitation to the applicability of the present invention.

EXAMPLES

Comparative Example 1

Using a forming apparatus as illustrated in FIG. 1, a nonwoven fabric was made by providing a precursor web comprising 100 weight percent polypropylene fibers. The web had a basis weight of 3 ounces per square yard (plus or minus 7%). The precursor web was 100% carded and cross-lapped, with a draft ratio of 2.5 to 1.

Prior to three-dimensional imaging of the precursor web, the web was entangled by a series of entangling manifolds such as diagrammatically illustrated in FIG. 1. FIG. 1 illustrates disposition of precursor web P on a foraminous forming surface in the form of belt 10, with the web acted upon by an entangling manifold 12. The web then passes sequentially over a drum 14 having a foraminous forming surface, for entangling by entangling manifold 16, with the web thereafter directed about the foraminous forming surface of a drum 18 for entangling by entanglement manifold 20. The web is thereafter passed over successive foraminous drums 22, with successive entangling treatment by entangling manifolds 24, 24'. In the present examples, each of the entangling manifolds included 120 micron orifices spaced at 42.3 per inch, with the manifolds successively operated at 100, 300, 700, and 1300 pounds per square inch, with a line speed of 45 yards per minute. A web having a width of 72 inches was employed.

The entangling apparatus of FIG. 1 further includes a three-dimensional imaging drum 24 comprising a three-dimensional image transfer device for effecting imaging and patterning of the now-entangled precursor web. The entangling apparatus includes a plurality of entangling manifolds 26, which act in cooperation with the three-dimensional image transfer device of drum 24 to effect patterning of the fabric. In the present example, the imaging manifolds 26 were successively operated at 2800, 2800, and 2800 pounds per square inch, at a line speed which was the same as that used during pre-entanglement.

Example 1

A three-dimensionally imaged nonwoven fabric was manufactured by a process as described in Comparative Example 1, wherein in the alternative, and in accordance with the present invention, a lighter 1.5 ounce per square yard polyester staple fiber web was juxtaposed with a 1.5 ounce polyester spunbond web of approximately 2.0 denier. The staple fiber web/spunbond web layered matrix was then subjected to equivalent hydraulic pressures as described in Comparative Example 1.

The imaged nonwoven fabrics made in accordance with the present invention exhibit greater three-dimensional image clarity and are more pronounced than the image imparted to equivalent basis weight materials without the support layer or scrim. Imaged nonwoven fabrics, such as Example 1, exhibit a significantly reduced elongation performance, resulting in improved image retention during mechanical processing and use.

The material of the present invention may be utilized as a secondary carpet backing as well as provide for backing material of various floor systems, including floating laminate floor systems, and other end use products where a three-dimensionally imaged nonwoven fabric can be employed. Other end uses include; fabrication into acoustic wall systems, automotive applications, wet or dry hard surface wipes, which can be readily hand-held for cleaning and the like, protective wear for industrial uses, such as gowns or smocks, shirts, bottom weights, lab coats, face masks, and the like, and protective covers, including covers for vehicles such as cars, trucks, boats, airplanes, motorcycles, bicycles, golf carts, as well as covers for equipment often left outdoors like grills, yard and garden equipment, such as mowers and roto-tillers, lawn furniture, floor coverings, table cloths and picnic area covers.

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A method of making a carpet including a secondary carpet backing fabric, comprising the steps of:

providing a fibrous matrix comprising staple length fibers;

providing a support layer comprising a continuous filament support layer in the form of a spunbond fabric;

providing a foraminous surface in the form of a three-dimensional image transfer device;

juxtaposing said fibrous matrix and said support layer and applying hydraulic energy to entangle said fibrous matrix and said support layer into a precursor web;

hydroentangling said precursor web on said foraminous surface to form a three-dimensionally imaged nonwoven fabric; and integrating said imaged nonwoven fabric in the form of a secondary carpet backing fabric with associated carpet components to form a carpet.

2. A method of making a carpet including a secondary carpet backing fabric, comprising the steps of:

providing a fibrous matrix comprising staple length fibers;

providing a support layer comprising a continuous filament support layer in the form of a spunbond fabric;

carding said fibrous matrix;

cross-lapping said fibrous matrix to form a precursor web;

entangling said precursor web on a foraminous forming surface;

juxtaposing said support layer onto said precursor web;

providing a three-dimensional image transfer device comprising an imaging surface having an array of three-dimensional surface elements, said imaging surface being movable relative to at least one associated hydroentangling manifold;

hydroentangling said precursor web on said imaging surface so that portions of said precursor web are displaced from on top of said three-dimensional surface elements to form an imaged and patterned nonwoven fabric; and integrating said imaged and patterned nonwoven fabric in the form of a secondary carpet backing fabric with associated carpet components to form a carpet.

* * * * *